United States Patent [19]

Poo et al.

[11] 4,068,579

[45] Jan. 17, 1978

[54] CYLINDRICAL CONTAINER SILK SCREEN PRINTER WITH COORDINATED SCREEN HEIGHT AND STROKE ADJUSTMENT INDEXING MECHANISM

[75] Inventors: Ramon E. Poo; Faustino Poo, both of Miami, Fla.

[73] Assignee: Ventura International, Inc., Hialeah, Fla.

[21] Appl. No.: 654,551

[22] Filed: Feb. 2, 1976

[51] Int. Cl.[2] ..... B41F 17/32

[52] U.S. Cl. ..... 101/38 R; 101/124; 101/126

[58] Field of Search ..... 101/38 R, 38 A, 39, 101/40, 126, 124, 123

[56] References Cited

U.S. PATENT DOCUMENTS

| | | | |
|---|---|---|---|
| 2,237,168 | 4/1941 | Smith | 101/124 |
| 2,261,255 | 11/1941 | Jackson | 101/124 |
| 2,492,052 | 12/1949 | Martin | 101/124 |
| 2,629,321 | 2/1953 | Gattuso | 101/126 |
| 2,702,001 | 2/1955 | Gattuso | 101/38 R X |
| 3,109,365 | 11/1963 | Karlyn | 101/124 |
| 3,277,816 | 10/1966 | Olsen | 101/38 R |
| 3,638,564 | 2/1972 | Prange et al. | 101/126 X |

*Primary Examiner*—Clifford D. Crowder
*Attorney, Agent, or Firm*—Ernest H. Schmidt

[57] ABSTRACT

An apparatus for the silk screen printing of labels, artwork, descriptive material, etc. on cylindrical containers. The silk screen is prepared and set up in a carriage for reciprocative movement above a container cradle assembly positioned for pivotally moving a container into and out of peripheral engagement with the underside of the silk screen. An adjustable measuring device is provided to receive a cylindrical container and to indicate the diameter thereof on a calibrated scale in indexing reference numeral graduations. The measuring device is interconnected with an air cylinder utilized to drive the container cradle assembly so as to control the pivotal stroke thereof to properly position all subsequent like-diameter containers inserted in the cradle for the silk screen printing operation and for removal from the cradle. A corresponding scale is provided on an adjustable drive linkage from a second air cylinder device to the silk screen carriage mechanism, whereby, upon adjustment of the drive linkage to correspond with the reference numeral index of the measuring device, correlation of the reciprocative movement of the screen to the diameter of the bottle will automatically be achieved.

21 Claims, 11 Drawing Figures

CYLINDRICAL CONTAINER SILK SCREEN PRINTER WITH COORDINATED SCREEN HEIGHT AND STROKE ADJUSTMENT INDEXING MECHANISM

BACKGROUND OF THE INVENTION

The use in silk screening machines for printing labels, artwork, descriptive material, etc. on containers or bottles is well known. Such machines are substantially automatic in operation beginning with the placement of a container on a bottle holding fixture or cradle. Upon such placement, the mouth of the container is engaged by an air chuck which inflates the container (if of a flexible material such as polystyrene, for example) to provide a solid surface for the screening, after which the fixture or cradle support mechanism is raised to a position just below the screen, and indexing means rotates each container to a precise starting position after which the indexing means is automatically disengaged. The silk screen squeegee is then automatically lowered and the silk screen moved laterally on its carriage, simultaneously rotating the container on its cradle fixture to screen the particular image on to the container.

Such silk screen printers as have heretofore been devised, however, are deficient in various respects, principally in that, because the mechanisms for automatically raising the container to screening height, and for effecting the screening stroke thereafter, operated independently of one another, and therefore uncoordinated except for being sequentially operative, resetting of these mechanisms was very time consuming. Thus, in effecting a "set-up" change-over it was necessary to stepwisely adjust, by trial and error, both the container raising mechanism and the silk screen stroke mechanism until proper coordination was empirically achieved. Since such procedures required the services of experienced technicians and could not ordinarily be accomplished by the machine operator, labor costs and loss of machine operating time involved in silk screening production, particularly of short runs on different diameter containers requiring frequent resetting of the screening height and stroke mechanisms, were substantial.

The present invention pertains to a semi-automatic silk screen printer device in which a "set-up" or change-over can be accomplished in a matter of minutes by a briefly trained mechanically apt operator. A simple measuring device is provided to determine the diameter of a cylindrical container in terms of an index reference numeral on a calibrated scale. The measuring device is attached to the stationary end of an air cylinder assembly in such a manner as to position the air cylinder relative to a container in said measuring device and an associated pivotal container cradle for sequentially carrying containers of a like diameter into proper abutting engagement with the underside of a silk screen for the printing sequence. To this end, the piston rod of the air cylinder is pivotally attached to the extended end of a pivoted cradle carriage assembly. An adjustable drive linkage driven by a second air cylinder, is provided with like index numeral graduations to provide for adjustment thereof to correlate horizontal reciprocating movement of the silk screen to the diameter of the containers being printed.

Accordingly, the principal object of the present invention is to provide calibrated scale measuring means for accurately determining the diameter of a container in terms of a reference or index number, including pivotal drive means connecting between the measuring means and a container supporting cradle assembly for sequentially moving the cradle from container load and unload position to a printing position, and back to a container load and unload position again.

Another object of the invention is to provide an adjustable linkage means in driving interconnection between a second air cylinder device and a silk screen carriage assembly fitted with a silk screen prepared in a conventional manner, to impart the desired printed material on each container while it is in the raised position.

Yet another object of this invention is to provide a like reference or index numeral scale on the adjustable linkage means enabling its accurate adjustment for imparting a horizontal reciprocating movement to the silk screen carriage assembly precisely correlated to the diameter of the container being printed.

A still further object of the invention is to provide third and fourth air cylinder drive means correlated to the movement of the silk screen carriage assembly for sequentially moving a squeegee and an ink flood bar, respectively, into and out of engagement with the upper surface of the silk screen.

DETAILED DESCRIPTION OF THE DRAWINGS

Figure 1:
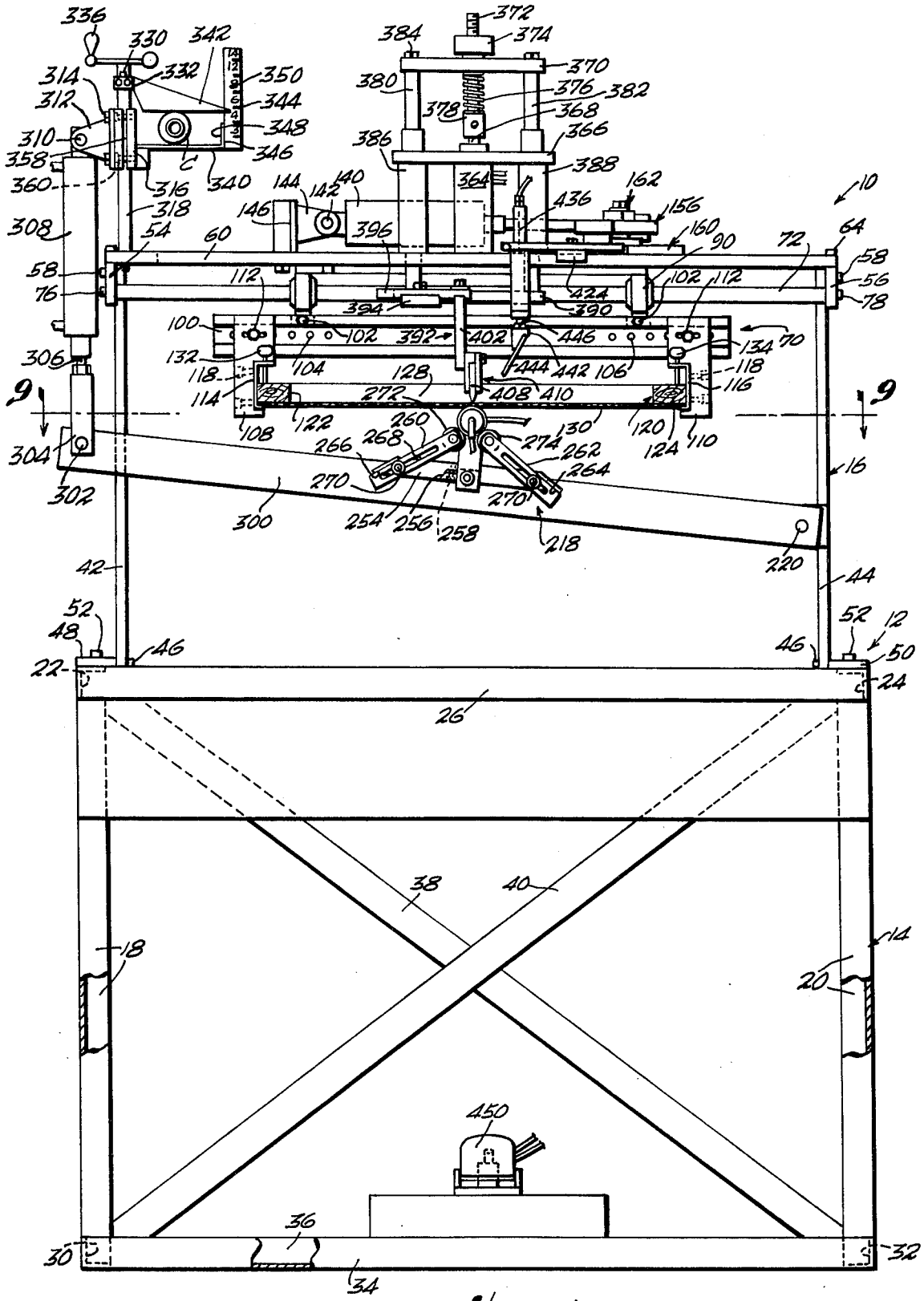
FIG. 1 is a front elevational view of the silk screen printer device with the operating parts thereof illustrated in container printing position.
Figure 2:
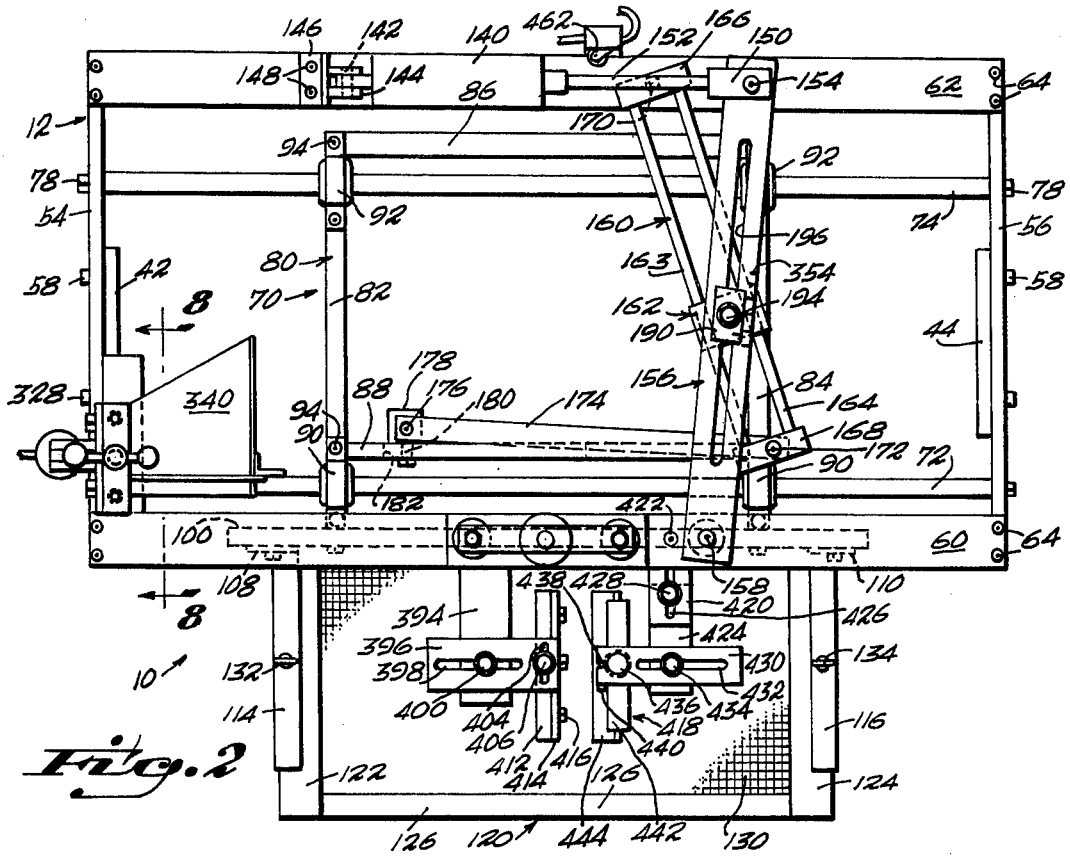
FIG. 2 is a top plan view of FIG. 1.

With reference to the drawings, in which like reference numerals designate like or corresponding parts throughout the various views, and with particular reference to FIGS. 1 and 2, the silk screen printer device of the present invention is indicated generally at 10 and includes a main frame 12 comprised of a lower frame portion 14 and an upper frame portion 16.

Figure 9:
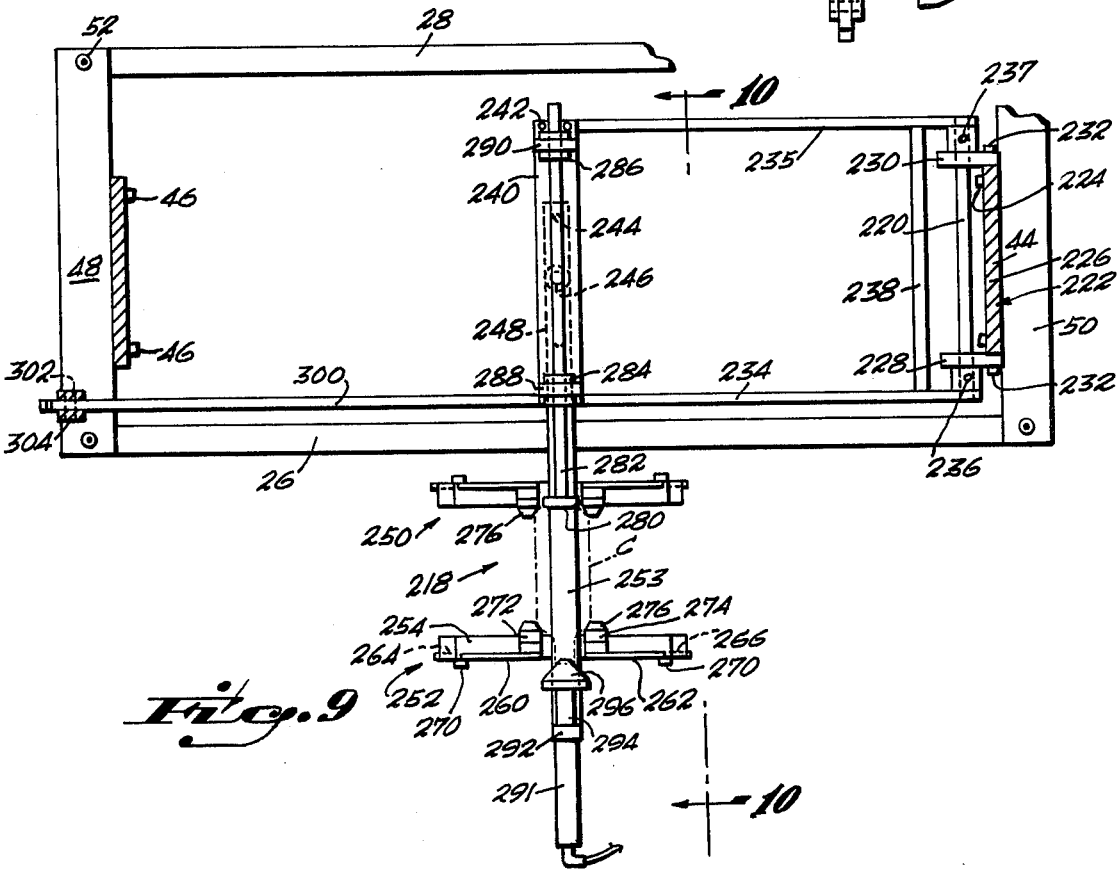
FIG. 9 is a fragmentary cross-sectional view taken along line 9—9 of FIG. 1.
Figure 10:
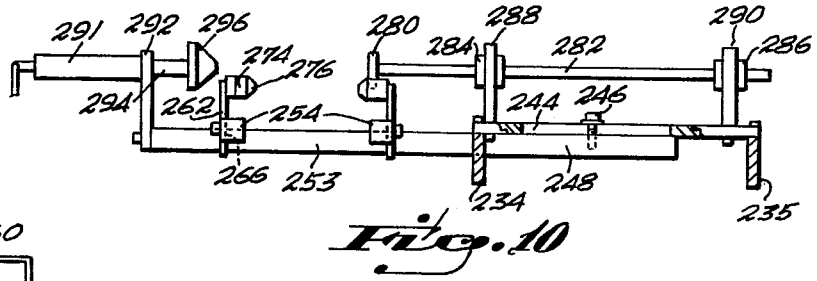
FIG. 10 is a cross-sectional view taken along line 10—10 of FIG. 9.

The lower frame portion 14 includes opposed pairs of front and back legs 18 and 20, the upper ends of which are interconnected by side members 22 and 24 and front and back longitudinal members 26 and 28, (FIG. 9). Similar side, front and back members 30, 32, 34 and 36 interconnect the bottom leg ends. All of the above mentioned lower frame members are preferably formed of angle iron. A pair of diagonally disposed cross braces 38 and 40 interconnect respective opposed upper and lower leg ends.

The upper frame is comprised of a pair of opposed vertical side plates 42 and 44, bolted as at 46 to side members 48 and 50 which are, in turn, bolted as at 52 to top side members 22 and 24 of the lower frame portion 14. With further reference to FIGS. 1 and 2, transverse end rail members 54 and 56 are bolted as at 58 to the upper ends of respective vertical plates 42 and 44, the respective front and back ends of transverse plates 54 and 56 being spanned by bars 60 and 62 bolted in place as at 64.

A silk screen carriage 70 is slidably journalled on a pair of longitudinally-extending slide bars 72 and 74, fixed as by bolts 76 and 78 between the transverse rail members 54 and 56. The carriage 70 includes a generally rectangular slide frame 80 comprised of end rails 82 and 84, spanned by a back rail 86, fixed between the back ends thereof, and a rail 88 fixed inwardly of their forward ends. Front and back pairs of slide bearings 90 and 92 are bolted at 94 to end rails 82 and 84 for sliding movement along slide rods 72 and 74.

A longitudinally-extending mounting rail 100 is bolted as at 102 across the front ends of side rails 82 and 84 and includes pluralities of spaced-apart adjustment holes 104 and 106 in its respective end portions. Vertically-downwardly-extending mounting brackets 108 and 110 are selectively bolted at 112 to mounting rail 100 by means of holes 104 and 106. A pair of forwardly-extending, inwardly-opening channel members 114 and 116 are bolted as at 118 to respective brackets 108 and 110 for the sliding reception of a silk screen frame 120 having a pair of side rails 122 and 124, and front and back rails 126 and 128. A prepared silk screen 130 of the type conventionally utilized in the silk screen printing process is peripherally attached to the underside of frame 120. A pair of thumb screws 132 and 134, threaded through the upper flanges of respective channels 114 and 116, engage the side rails 122 and 124 of screen frame 120 for adjustable locking purposes.

An air cylinder 140 is pivotally mounted at 142 along the top face of back bar 62, between yoke arms 144 of a mounting bracket 146, said bracket being bolted to bar 62 as at 148. An extended yoke end portion 150 of the cylinder piston rod 152 is pivotally attached at 154 to the inner end of a first lever arm 156 which, in turn, is pivotally attached at its forward end at 158 to the front frame bar 60.

Connecting between first lever arm 156 and a second lever arm 160 is a slidable, lockable adjustment means 162 for the purpose hereinafter described. Second lever arm 160 is comprised of a pair of spaced-apart, parallel slide rods 163 and 164 connected at their respective back and forward ends by cross bars 166 and 168. At its back end, second lever arm 160 is pivotallly connected at 170 to back frame bar 62, and at its front end it is pivotally connected at 172 to one end of a link 174. Link 174 is pivotally connected at its other end, as at 176 to a block 178 which is adjustably bolted at 180 to silk screen carriage rail 88 through an elongated slot 182. Reciprocative movement of piston rod 152 will thereby be imparted to the silk screen carriage 70.

Figure 6:
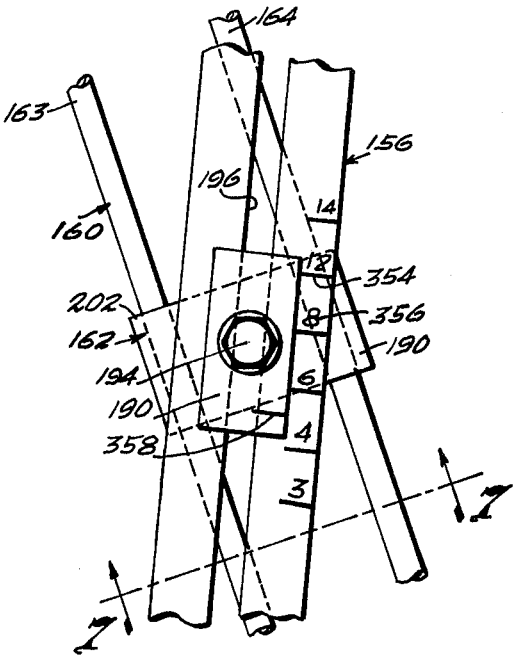
FIG. 6 is an enlarged, fragmentary plan view of the central portion of the adjustable linkage means, as seen in FIG. 1, to better illustrate the details thereof.
Figure 7:
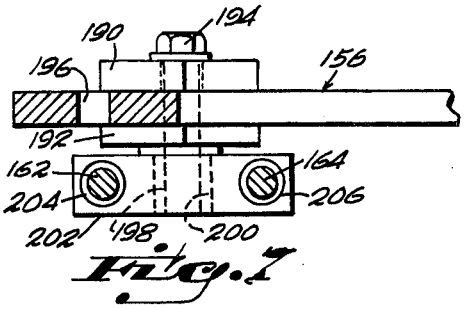
FIG. 7 is a cross-sectional view taken along line 7—7 of FIG. 6.

With particular reference to FIGS. 2, 6 and 7, the lever arm adjustment means 162 is comprised of upper and lower clamp blocks 190 and 192 which are adjustably locked against the upper and lower surfaces of lever arm 156 by means of a bolt 194 extending therethrough. An elongated slot 196 is provided along a substantial length of the lever arm 156 for passage therethrough of bolt 194. A pivot pin 198, extending downwardly of the lower clamp block 192 is rotatably engaged in a bearing 200, said bearing being fixed centrally of a slide block 202 slidably arranged along the parallel slide rods 163 and 164 by means of sleeve bearings 204 and 206.

Figure 3:
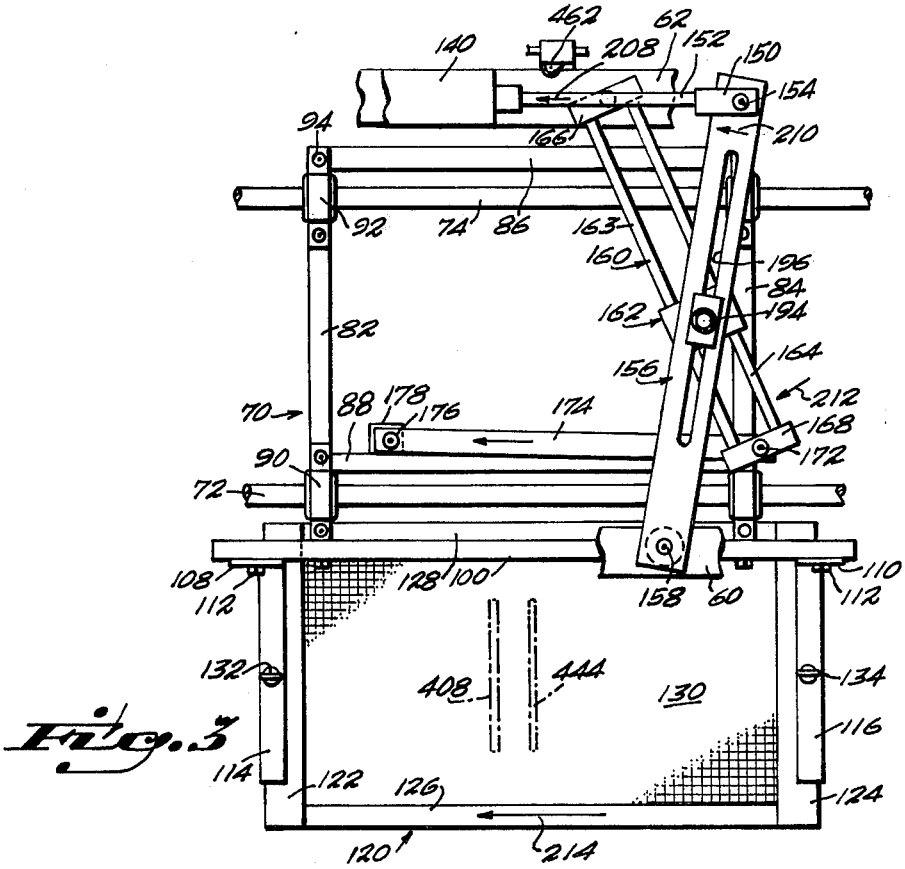
FIG. 3 is a top plan view similar to FIG. 2 with parts broken away and illustrating the start of the printing stroke of the silk screen.
Figure 4:
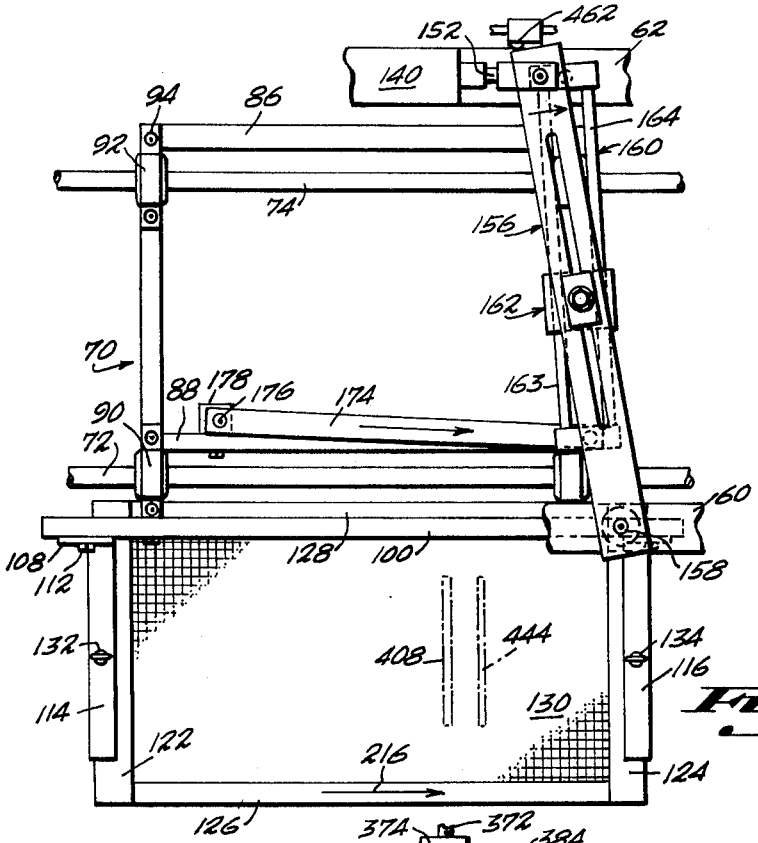
FIG. 4 is a view similar to FIG. 3, illustrating the start of the return stroke of the silk screen.

As can be seen in FIG. 3, inward movement of piston rod 152, as indicated by arrow 208, causes movement of lever arms 156 and 160 in the directions indicated by respective arrows 210 and 212 to impart movement to the silk screen carriage assembly 70 to the left as indicated by arrow 214. With reference to FIG. 4, outward movement of piston rod 152 causes the silk screen carriage assembly 70 to move to the right, as indicated by arrow 216.

Referring particularly to FIGS. 1,2,5, and 9 and 10, a container carriage assembly 218 is pivotally attached at 220 to a bracket 222, bolted at 224 to the upper frame vertical end plate 44. As seen in FIG. 9, bracket 222 is generally U-shaped and is comprised of a base member 226 and front and back ears 228 and 230 bolted thereto at 232. Pivot rod 220 is journalled through ears 228 and 230. The container carriage assembly 218 is comprised of front and back arms 234 and 235 fixed at 236 and 237 to pivot rod 220, a cross brace 238 fixed between the arms 234 and 235, adjacent pivot rod 220, and a cross bar 240 bolted as at 242 to arms 234 and 235 in a position beneath and generally centrally of the silk screen carriage assembly 70. Cross bar 240 is centrally slotted along its length at 244 for adjustable attachment by a lock nut 246 to a forwardly-extending bar 248. A pair of cradle assemblies 250 and 252 are adjustably fixed in a spaced relation along the forward extended portin 253 of the bar 248.

Figure 5:
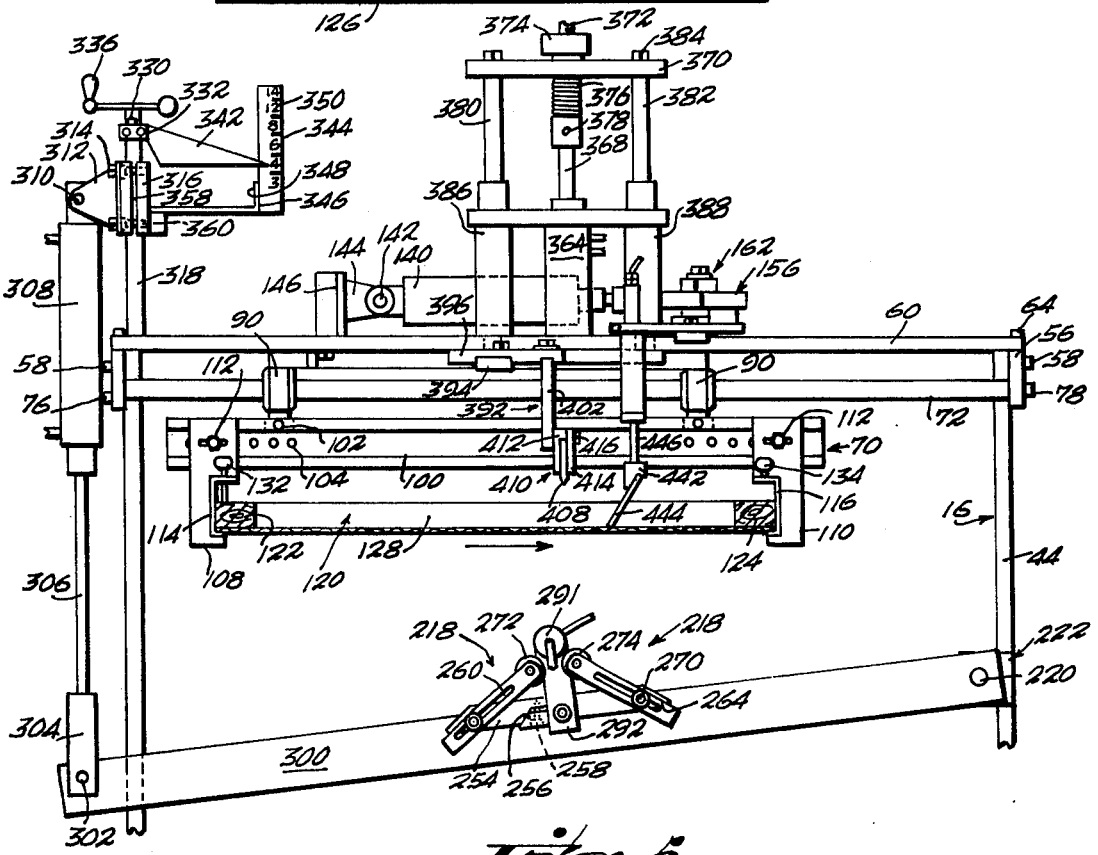
FIG. 5 is a fragmentary front elevational view similar to FIG. 1, but with the operating parts in the positions of FIG. 4.

Each of the cradle assemblies 250 and 252 includes a centrally grooved crossbar 254, FIGS. 1 and 5, adjustably fixed to extension 253 by a wedge and set-screw 256 and 258, and a pair of opposed, upwardly-converging support arms 260 and 262 slidable in grooves 264 and 266 in the opposed ends of cross bar 254. Each support arm, such as 260, is longitudinally slotted at 268 for adjustable attachment in a groove, such as indicated at 264, by a set-screw 270. Rollers 272 and 274 are carried by the confronting ends of the support arms of both cradle assemblies. In use, the support arms 260 and 262 of both cradle assemblies are adjusted to position their pairs of rollers 272 and 274 in respective supporting engagement with the top and bottom peripheral edge portions of a container C, illustrated in broken lines in FIG. 9. As illustrated, the container engaging ends of all of the rollers are chamfered as at 276.

A disc 280 carried on the forward end of a rod 282 further supports the bottom wall of the container C. Red 282 is journalled at 284 and 286 in upwardly-extending ears 288 and 290 fixed relative to the opposed top end portions of cross bar 240.

When plastic containers are being printed, in a manner subsequently to be described, an air cylinder 291 is fixed to an arm 292 carried on the forward end of bar extension 253. The piston 294 of cylinder 291 is positioned axially of the container to engage an enlarged, chamfered head portin 296 thereof in sealing engagement in the open top or mouth of the container and to simultaneously prssurize the interior of the container to maintain the peripheral wall thereof in a substantially rigid condition during the printing operation.

Figure 8:
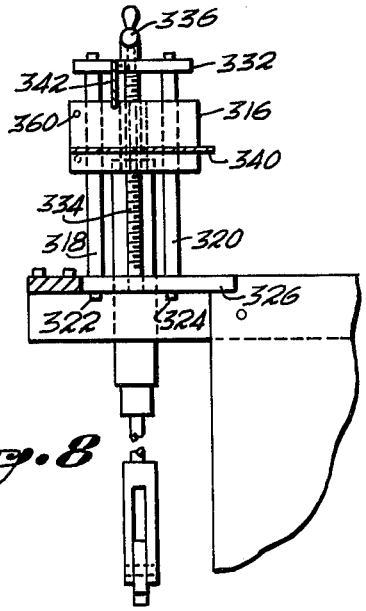
FIG. 8 is a fragmentary cross-sectional view taken along line 8—8 of FIG. 2.

The front arm 234 of container carriage assembly 218 includes an extended portion 300, the end of which is pivotally connected at 302 in the yoke end 304 of a piston rod 306 comprising an air cylinder 308. The air cylinder 308 is pivotally connected at its upper end to a yoke bracket 312, as indicated at 310. Bracket 312 is bolted at 314 to a slide block 316 carried on a pair of vertical slide rods 318 and 320, as best illustrated in FIG. 8. Vertical slide rods 318 abd 320 are bolted at 322, 324 to a block 326 fixed as by bolts 328 to the end rail member 54. The upper ends of the slide rods 318 and 320 are bolted at 330 to a cross bar 332, and a central screw rod 334, journalled in cross bar 332, extends downwardly in screw threaded engagement through the slide block 316. Turning of a hand lever 336, fixed atop screw rod 334, serves to vertically adjust the position of the air cylinder 308 as carried by the slide block 316, resulting in a selective up and down adjustment of the range area of pivotal movement of the container carriage assembly 218.

As best illustrated in FIGS. 1,2 and 5, a platform 340 is fixed relative to the slide block 316 in any conventinal manner, and a pointer 342 is fixed to the stationary cross bar 332. A vertically-extending scale 344 is fixed at 346 to an upturned flange 348 on the extended end of platform 340. The scale 344 is calibrated with a plurality of reference characters, such as index numerals indicated at 350.

In operation, the slide block 316 is lowered by screw rod 334 sufficiently to permit the placing on platform 340 of a sample container C of the diameter of those in a run to be printed. The hand lever 336 is then manipulated to raise the platform 340 until the container C comes into abutting engagement with the bottom edge of pointer 342. This automatically positions a like container C disposed in the cradle assemblies 250 and 252 as above described, for proper pivotal movement into engagement with the silk screen 130 to be printed. The silk screen will have been properly prepared in a conventional manner to apply the desired printed material on the container C. Therefore, a very rapid "set-up" or "changeover" can be accomplished to accommodate container runs of varying diameters for movement into proper printing position relative to the silk is to be noted that while the upward movement of the carriage supporting the container cradle assemblies is curvilinear, the curviture is so slight and the angle with respect to the horizontal is so small as results in substantially equal vertical travel of the piston rod 306 and the carried container in operation of the device, no matter what diameter of container is set up for screen 130.

With reference to the lever arms 156 and 160 in FIGs. 2 and 6, a calibrated scale 354 is imprinted in, or otherwise applied to a top edge portion of lever arm 156. The scale includes a plurality of aligned reference numerals 356 corresponding with and correlated to the reference index numerals 350 on scale 344. To adjust the reciprocative stroke of lever arm 160, the lock bolt 194 is loosened and the adjustment means 162 is manually slid along the two lever arms 156 and 160 until a reference or index mark 358 on the upper clamp block 190 is aligned with a reference or index numeral 350 indicated on scale 344 by pointer 342. The reciprocating stroke of the silk screen carriage 70 and the silk screen 130 will then be automatically correlated to the diameter of the container C on platform 340. One side of the slide block 316 is vertically slotted as at 358, and a pair of clamp screws 360 serve to lock the slide block 316 relative to one slide rod, such as 318, during initial calibration of the machine.

An air cylinder 364 is vertically mounted centrally of the top, front bar 60 between said bar 60 and an upper cross bar 366. The piston rod 368 of air cylinder 364 extends upwardly through a top bridge bar 370 and provides a screw threaded outer end portion 372 for the reception of a squeegee stroke adjustment bolt 374. A compression spring 376 is circumposed the piston rod 368, constrained between the underside of bridge bar 370 and a collar 378 fixed to said piston rod.

A pair of vertical slide rods 380 and 382 are bolted at 384 at their upper ends to the underside of bridge bar 370 in parallel relation to the opposed sides of piston rod 368. Slide rods 380 and 382 respectively traverse a pair of sleeves 386 and 388 fixed between the cross bar 366 and top, front bar 60, and project through bar 60 for attachment to a carriage plate 390 of a squeegee assembly 392. Squeegee assembly 392 comprises a forwardly-extending arm 394 fixed at its inner end to the carriage plate 390, a longitudinal plate 396, longitudinally adjustably fixed to the extended end portion of arm 394 by means of an elongated slot 398 therein and a lock bolt 400, a vertical bar 402 laterally adjustably fixed to the extended end of plate 396 by means of an elongated slot 404 therein and a block nut 406, and a squeegee blade 408, fixed in a carriage 410 which is in turn fixed to the lower extended end of vertical bar 402. The squeegee carriage 410 is comprised of an angle member 412 which seats the blade 408 and a clamp plate 414 bolted at 416 to angle member 412.

A flood bar assembly 418 is carried by the front bar 60 and includes a first fowardly-extending plate 420 bolted at 422 to bar 60 and a second, forwardly-extending plate 424 adjustably fixed thereto by means of an elongated slot 426 and a lock nut 428. A longitudinally-extending plate 430 is adjustably carried on the extended end portion of plate 424 by means of an elongated slot and lock bolt 432 and 434, and an air cylinder 436 is vertically downwardly clamped in a hole in the extended end of plate 430 by means of a slot 438 and lock bolt 440. Fixed to a head portion 442, a flood bar 444 is carried on the bottom end of the piston rod 446 of air cylinder 436 for movement into and out of engagement with the top surface of silk screen 130.

Figure 11:
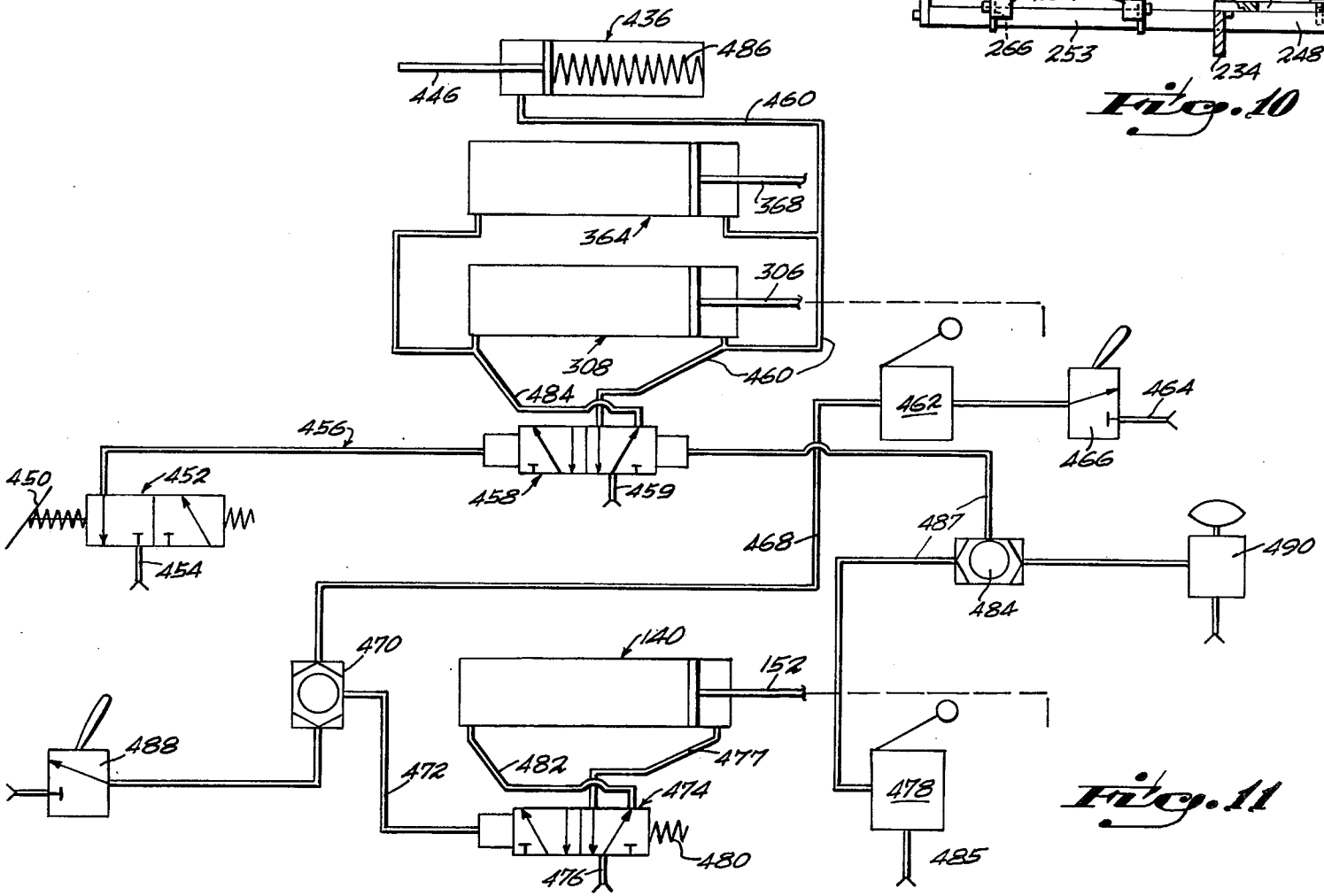
FIG. 11 is a schematic illustration of the pneumatic system of the invention.

With reference to the pneumatic operating diagram of FIG. 11, actuation of foot treadle 450 operates the 3-way valve 452 to shift same to provide a supply of compressed air from conduit 454 through conduit 456 to the 4-way valve 458 which is shifted to provide compressed air from a supply conduit 459 to a feed conduit 460 to the container carriage cylinder 308, the squeegee cylinder 364, and flood bar cylinder 436. All three piston rods 306, 368 and 446 of the respective air cylinders are simultaneously retracted to pivot the container carriage assembly 218, extend the squeegee carriage assembly 410 and retract the flood bar 444 from their respective positions in FIG. 5 to their positions in FIG. 1. The silk screen 130 is then frictionally engaged between the squeegee blade 408 and the container C in the cradle assemblies 250 and 252; and the flood bar 444 is retracted from contact with silk screen 130.

A first limit valve 462 is actuated, as by the piston rod 306, to provide a supply of compressed air from conduit 464 through closed toggle valve 466, through conduit 468 to a shuttle valve 470, which is actuated to direct the compressed air through a conduit 472 to a 4-way valve 474. The 4-way valve is thereby actuated to direct a flow of compressed air from a supply conduit 476 through conduit 477 to the silk screen carriage air cylinder 140 to retract the piston rod 152 to initiate the printing stroke of the silk screen, as illustrated in FIG. 3. The frictional contact of the squeegee blade 408 and the container C with the silk screen 130 therebetween, causes said container to rotate with the printing stroke of the screen 130. Squeegee blade 408 passes ink through the silk screen 130 in the conventional manner to apply the printing on the prepared silk screen to the cylindrical wall of the container C.

At the end of the printing stroke, a second limit valve 478 is actuated by piston rod 152 to actuate the shuttle valve 484 from a pressure source 485 through conduit means 487 to a 4-way valve 458 to direct the flow of compressed air from the supply conduit 459 to a conduit 484 leading to the container carriage cylinder 308 to extend the piston rod 306 and thereby move the container C out of engagement with silk screen 130 to the position of FIG. 5 and to the squeegee cylinder 364 to extend the piston rod 368 so as to raise the squeegee blade 408 from screen 130. The flood bar piston 446 is automatically extended by spring 486 to engage the flood bar with silk screen 130 to distribute the ink thereon over its printing area during the return stroke thereof.

When piston rods 306 and 368 are retracted, the source of supply of compressed air from conduit 464 is shut off by the closing of limit valve 462. Therefore, spring 480 shifts 4-way valve 474 to supply pressurized air from supply conduit 476 through conduit 482 to extend piston rod 152 to retract the screen 130 to its start position. Manual control valves such as 48 and 490 may be included in the system.

While I have illustrated and described herein only one form in which my invention can conveniently be embodied in practice, it is to be understood that this embodiment is presented by way of example only and not in a limiting sense. My invention, in brief, comprises all the embodiments and modifications coming within the scope and spirit of the following claims.

What I claim as new and desire to secure by Letters Patent is:

1. A device for a silk screen printing the outer peripheral surface of a cylindrical container comprising, in combination, a first carriage means for supporting a printing screen prepared with printing indicia; a second carriage means beneath said printing screen for supporting the container to be printed for rotational movement about its longitudinal axis, means for measuring the diameter of a container, means connecting said diameter measuring means with a first drive means to sequentially move said second carriage means, with said container, into and out of a position whereat the cylindrical surface of said container is in abutting contact with the bottom surface of said screen, a second drive means to reciprocatively drive said first carriage means to effect a printing stroke in a first directiion and a return stroke in the opposite direction, means to force ink deposited on the top surface of said printing screen through said silk screen, a third drive means to move said ink forcing means into engagement with the top surface of said screen on said printing stroke to effect printing of said indicia on the cylindrical container surface and to raise said ink forcing means from said top surface on said return stroke, and means for adjusting said printing and return strokes of said first carriage means so as to be correlated with the diameter of the container being printed and the movements of said second carriage means.

2. A silk screen printing device as defined in claim 1 wherein said container diameter measuring means comprises a bottom platform for supporting the container, an upper fixed member, and means to adjustably move said platform to diametrically engage the container with said fixed member.

3. A silk screen printing device as defined in claim 2 including a first vertically disposed-scale means, fixed relative to an extended end portion of said platform and having a first calibrated plurality of aligned index characters therealong.

4. A silk screen printing device as defined in claim 3, wherein said fixed member is in the form of a reference pointer for alignment relative to said index characters as determined by the diameter of the container being measured.

5. A silk screen printing device as defined in claim 4, wherein said second drive means includes a pair of lever arms with a pivotal connection therebetween, adjustable along a predetermined central portion thereof.

6. A silk screen printing device as defined in claim 5, wherein said second drive means further comprises a second pneumatically operated cylinder and piston assembly drivingly connected to a first end of the first of said pair of lever arms, the second end thereof being pivotally connected to a first frame member.

7. A silk screen printing device as defined in claim 6, wherein a first end of the second of said pair of lever arms is pivotally connected to a second frame member, spaced from said first frame member, and a seciond end is pivotally linked to said first carriage means.

8. A silk screen printing device as defined in claim 6, wherein said pivotal connection means includes a pair of clamp blocks disposed against the respective top and of said pair of bottom faces of lever arms, a clamp bolt passing through said clamp blocks, and an elongated longitudinal slot in said first lever arm.

9. A silk screen printing device as defined in claim 8, wherein pivotal connection means includes a slide block, pivotally connected to one of said clamp blocks, and through bearing means for sliding engagement along a second of said pair of lever arms.

10. A silk screen printing device as defined in claim 9, wherein said second lever arm is comprised of a pair of spaced apart, parallel slide rods with a pair of cross bars connecting between the respective end portions thereof.

11. A silk screen printing device as defined in claim 9, wherein said printing and return strokes correlating means comprises a second scale means, said second scale means having a second plurality of aligned index characters, correlated to said first index characters and disposed on said first lever arm, and a reference mark on the top clamp block for movement of said pivotal connection means into corresponding registration or indexing with said second plurality of index characters as determined by said first scale means.

12. A silk screen printing device as defined in claim 3, wherein said first drive means comprises a first pneumatically operated cylinder and piston assembly drivingly connected to an elongated pivotal lever arm of said second carriage means, said second carriage means being provided with adjustable cradle means for supporting the container to be printed.

13. A silk screen printing device as defined in claim 1, wherein said ink forcing means comprises a squeegee mounted in an adjustable carriage assembly.

14. A silk screen printing device as defined in claim 13, wherein said third drive means comprises a third pneumatically operated cylinder and piston assembly to move said squeegee into contact with the top surface of said screen during said printing stroke and to retract said squeegee during said return stroke.

15. A silk screen printing device as defined in claim 14, wherein said adjustable carriage assemblies includes longitudinal and lateral adjustment means to properly position the squeegee relative to the container being printed.

16. A silk screen printing device as defined in claim 15, including a flood bar for movement into general engagement with the top surface of said screen during said return stroke and away from said general engagement during said printing stroke.

17. A silk screen printing device as defined in claim 16, including an adjustable carriage means for longitudinal and lateral adjustment of said flood bar.

18. A silk screen printing device as defined in claim 17, including a fourth pnemuatically operated cylinder and piston assembly for sequential operation of said flood bar.

19. A silk screen printing device as defined in claim 1, including a pnemuatic system operative to actuate a first valve by means of a treadle to supply compressed air to shift a second valve, said second valve being operative to provide a first supply of compressed air to simultaneously actuate said first and third drive means to move said second carriage means with the container, and to move said ink forcing means, said ink forcing means comprising a squeegee movable into contact with said screen, said pneumatic system further being operative to supply compressed air through a first manually controlled valve, and through a limit valve, opened by the movements into said printing position, to shift a third valve to provide a supply of compressed air to said second drive means to initiate said printing stroke; said pneumatic system further being operative to supply compressed air through a second limit valve, opened at the limit of the printing stroke, to reverse shift said second valve to supply compressed air to simultaneously reverse said first and third drive means to move said second carriage means, with said container, and said squeegee, into retracted positions; said pneumatic system further being operative to supply compressed air through a second closed manually-controlled valve to reverse shift said third valve to supply compressed air to said third valve means to initiate said return stroke.

20. A silk screen printing device as defined in claim 19, wherein said first, second and third drive means are comprised of pneumatic cylinder and piston assemblies.

21. A silk screen printing device as defined in claim 20, including a flood bar actuated by a fourth pneumatic cylinder and piston assembly in series with said first and third drive means to move said flood bar into contact with said screen when said squeegee is retracted and to retract said flood bar when said squeegee is moved into contact with said screen.

* * * * *